US007448962B2

(12) United States Patent
Kusumoto

(10) Patent No.: US 7,448,962 B2
(45) Date of Patent: Nov. 11, 2008

(54) GOLF CLUB

(75) Inventor: Harunobu Kusumoto, Tokyo (JP)

(73) Assignee: Daiwa Seiko, Inc., Tokyo (JP)

( * ) Notice: Subject to any disclaimer, the term of this patent is extended or adjusted under 35 U.S.C. 154(b) by 428 days.

(21) Appl. No.: 11/242,861

(22) Filed: Oct. 5, 2005

(65) Prior Publication Data

US 2006/0073911 A1 Apr. 6, 2006

(30) Foreign Application Priority Data

Oct. 6, 2004 (JP) ..... P2004-294198

(51) Int. Cl.
*A63B 53/04* (2006.01)
*A63B 53/06* (2006.01)

(52) U.S. Cl. ..... 473/334; 473/335; 473/345; 473/349

(58) Field of Classification Search ..... 473/324–350, 473/287–291
See application file for complete search history.

(56) References Cited

U.S. PATENT DOCUMENTS 2,087,685 A * 7/1937 Hackney ..... 473/349
5,306,008 A * 4/1994 Kinoshita ..... 473/242
5,354,055 A * 10/1994 MacKeil ..... 473/314
5,435,551 A * 7/1995 Chen ..... 473/342
5,547,427 A * 8/1996 Rigal et al. ..... 473/345
5,836,830 A * 11/1998 Onuki et al. ..... 473/349
6,077,173 A * 6/2000 Stites ..... 473/334

FOREIGN PATENT DOCUMENTS

JP 60-153885 8/1985

* cited by examiner

*Primary Examiner*—Sebastiano Passaniti
(74) *Attorney, Agent, or Firm*—McGinn IP Law Group, PLLC

(57) ABSTRACT

A golf club of the invention has a head with a hollow outer shell construction which includes a crown portion, a sole portion, a back portion, a toe portion, a heel portion and a face portion which hits a ball and a shaft that is to be mounted on the head at a predetermined lie angle, wherein a weight concentrated portion is provided closer to a back portion side than to an axis of the shaft in the interior of the head in such a manner as to rise from a heel side to a toe side of the head with respect to a reference horizontal plane which regulates the lie angle.

20 Claims, 8 Drawing Sheets

GOLF CLUB

BACKGROUND OF THE INVENTION

The present invention relates to a golf club and more particularly to a wood-type golf club including a head with a hollow outer shell construction.

Generally, there are known golf clubs in which a heavy material is disposed in the interior of a head thereof so as to improve the directionality of a ball hit thereby. For example, there is disclosed in Patent Document No. 1 a golf club in which a heavy material is disposed on a back side of a head in such a manner as to extend in a toe-to-heel direction. According to a head like this, the center of gravity is not concentrated to a central area of a face but extends in the toe-to-heel direction, whereby an effect can be obtained that the directionality is still stabilized even in case a ball is hit by the head at a position which is offset slightly towards the toe or heel.

Patent Document No. 1: JP-A-60-153885

As shown in FIG. 1, a swing that is performed by a normal golf player shares the same series of key elements; setup, that is the basic address position, takeaway or backswing, downswing that occurs after the golf club reaches the top position to shift its movement from upward to downward, follow-through that occurs after impact of a ball, and finish. Then, it is considered that the ball can easily be caught at a predetermined position (the sweet spot) on the head when hit by stabilizing the locus or swing plane of the head from the takeaway to the impact point of the ball. In other words, unless the swing plane in the downswing to the impact point of the ball is stabilized, it becomes difficult to catch the ball at the predetermined position.

As to the swing plane, as shown in FIG. 2, it is generally said that a good swing plane is a swing plan that resides within a range defined between an axis S of the shaft resulting when the golf club is set to match its lie angle $\alpha$ at address and an axis S' which connects the root portion of the neck of the golf player with the ball when viewed from the side of the golf player. Namely, an ideal swing path is attained by swinging the golf club in such a manner that a resulting swing plane resides within the range defined by the axis S and the axis S', whereby a stable impact at the sweet spot can easily be realized.

Incidentally, when an unnatural force is applied during a swing to the impact point of the ball, there is caused a problem that the swing plane becomes unstable. This unnatural force is such as to result mainly from a centrifugal force exerted on the head that is attached to the shaft, and it is considered from this fact that a weight balance in the head is one of important factors needed to stabilize the swing plane.

As exemplarily shown in FIG. 3A, in the head of the golf club disclosed in Patent Document No. 1, a heavy material M1 attached to the head extends horizontally (when used here, "horizontally" means a direction which follows a horizontal plane P which constitutes a reference point when the head is set on the ground at its lie angle with the golf club set in its address position) in the toe-to-heel direction, and when a golf club like this is actually swung, the golf player feels during the downswing until the impact point is reached that a distal end side of the head is pulled. Namely, the realization of a stable swing plane is disrupted by the fact that the distal end side of the head is so pulled.

To explain this specifically, when considering a centrifugal force (a centrifugal force generated by the aforesaid weight distribution) exerted on the head portion in the midst of downsing, there is a tendency that the centrifugal force increases as the toe side is approached as shown in FIG. 3A.

To explain this in a simplified fashion, in the aforesaid weight distribution, let a centrifugal force exerted on a position P1 on the toe side be F1, a centrifugal force exerted on a central position P2 be F2 and a centrifugal force exerted on a position P3 on the heel side be F3, such a relationship as F1>F2>F3 results. Assuming that the head draws approximately a centrifugal path, and let the angular velocity thereof be $\omega$ and a weight at each position be m, the centrifugal force exerted on the head is defined like $F=mr\omega^2$ (r denotes a distance from a swing axis which is a center axis of the centrifugal path along a longitudinal direction of the shaft to a position where the weight exists).

In the aforesaid weight distribution, when considering that weight is evenly distributed in the toe-to-heel direction, while weights exerted on the respective points and the angular velocity are the same, in the heavy material that is distributed horizontally, distances r1, r2, r3 from the swing axis along the longitudinal direction of the shaft to positions where respective weight components exist become different from each other (r1>r2>r3). Namely, from the aforesaid equation, forces generated in the respective portions by the heavy material M1 become, as discussed above, F1>F2>F3 (the centrifugal forces exerted on the respective positions are shown by vectors in FIG. 3A, and the centrifugal force exerted on each position along substantially the longitudinal direction of the shaft becomes larger as the toe side is approached).

Then, the centrifugal force which differs in magnitude at the respective positions on the head (the force becomes larger as it approaches the toe side) acts such that an actual swing plane is caused to deviate from the ideal swing plane during downswing by the difference in centrifugal force so generated. Namely, since a component in a vertical direction X of a centrifugal force exerted along the longitudinal direction of the shaft due to the difference attempts to pull the head in a direction indicated by an arrow D1 in FIG. 3A, a force in a direction indicated by an arrow D1' is exerted on a grip portion of the shaft and hence constitutes a factor which disrupts the stable swing plane. In addition, since a component in a horizontal direction Y of the centrifugal force attempts to pull the head in a direction indicated by an arrow D1 in FIG. 4, this component also constitutes a factor that disrupts the stable swing plane.

Then, this component in the horizontal direction Y shows a strong tendency that the head is likely to travel on an in-to-out path S1 relative to a target line T at the time of impact and hence comes to disrupt the implementation of a stable impact (ideally, while it is good to impact the ball on an in-to-in path S relative to the target line T, in the event that a force exerted on the heel side becomes too large on the contrary, there is increasing a tendency that the head travels on an out-to-in path S2, and hence this comes to disrupt the implementation of a stable impact).

Thus, with the weight-concentrated material provided in the head in such a manner as to extend along the reference horizontal plane P in the toe-to-heel direction, the golf player tends to feel a change in centrifugal force due to the horizontally extending weight distribution. Even in case this occurs, experienced or high-level golf players have a technique to stabilize the disturbed swing plane by consciously or unconsciously moving the writs or the like. However, golf players who have no such technique tend to strike the ball along an unstable swing plane that is caused by the change in the centrifugal force or strike the ball along a swing plane that has not yet be rectified or stabilized sufficiently.

In addition, even with general heads of golf clubs in which the heavy material described above is not provided, when compared with other heads having outer shell constructions, since the sole portion of the head is formed thick along the horizontal direction, its weight distribution resembles that of the heavy material M1 shown in FIGS. 3A and 3B in which weight is distributed to extend horizontally in the toe-to-heel direction, this causing a factor which disrupts the stable swing plane at the time of downswing.

It is considered from the description that has been made heretofore that the stable swing plane can be maintained in the swing to the impact point by constructing such that the force indicated by the arrow D1 in FIG. 3A and the force indicated by the arrow D2 in FIG. 4 are generated as little as possible in the head.

SUMMARY OF THE INVENTION

The invention is made in view of the problem that has been discussed above, and an object thereof is to provide a golf club which can realize the stabilization of the swing plane from setup or address to impact position to thereby attain a stable blow of a ball at the time of impact.

With a view to attaining the object, according to an aspect of the invention, there is provided a golf club having a head with a hollow outer shell construction comprising a crown portion, a sole portion, a back portion, a toe portion, a heel portion and a face portion where a ball is hit and a shaft attached to the head at a predetermined lie angle, wherein a weight-concentrated portion is provided closer to a back portion side than to an axis of the shaft in an interior of the head in such a manner as to rise from a heel side to a toe side with respect to a reference horizontal plane which regulates the lie angle.

According to another aspect of the invention, there is provided a golf club having a head with a hollow outer shell construction comprising a crown portion, a sole portion, a back portion, a toe portion, a heel portion and a face portion where a ball is hit and a shaft attached to the head at a predetermined lie angle, wherein a heavy material which is disposed with a directionality directed from a heel side to a toe side is provided closer to a back portion side than to an axis of the shaft in an interior of the head, and wherein the heavy material is disposed in such a manner as to be higher at the toe portion than at the heel portion with respect to a reference horizontal plane which regulates the lie angle.

According to the golf clubs having the heads that are configured as has been described above, since the portion where the weight is concentrated (including a portion that is molded integrally with the outer shell member or a portion that is attached to the outer shell member as a weight which is a heavy member) has the directionality in which the relevant portion rises from the heel side to the toe side, the distances from the swing axis along the longitudinal direction of the shaft to the positions where the weights exist can be set so as to be substantially equal as much as possible over the direction in which the weights are concentrated or so as to have a tendency that the distances become equal to each other. As a result, as shown in FIG. 3B, centrifugal forces F1, F2, F3 which are exerted, respectively, on the head portion at a position P1 on a toe side, a position P2 at a central portion and a position P3 on a heel side can be made to become substantially equal in magnitude or tend to do so. Consequently, since the centrifugal forces exerted on the head at the respective positions are stabilized, the exertion of an unnatural force like those shown in FIGS. 3A and 4 on the distal end side of the head can be prevented during downswing, thereby making it possible to hit a ball in a stable swing plane that thereby results from the start of a downswing to the impact point of the ball. Then, since the ball can be hit in the stable swing plane, the ball can easily be caught at the sweet spot of the head, whereby the directionality of the ball so hit can be stabilized and an increase in distance can be realized.

According to the invention, the golf club can be obtained which realizes the stabilization of the swing plane from the setup or address to the impact point and hence hits a ball in a stable fashion at the time of impact of the ball.

BRIEF DESCRIPTION OF THE DRAWINGS

FIGS. 3A and 3B are front views which schematically illustrate centrifugal forces exerted on a head portion of a golf club during downswing, in which FIG. 3A is a front view showing a related art golf club and FIG. 3B is a front view showing a golf club according to the invention.

DETAILED DESCRIPTION OF PREFERRED EMBODIMENTS

A golf club according to the invention will be described below.

Figure 5:
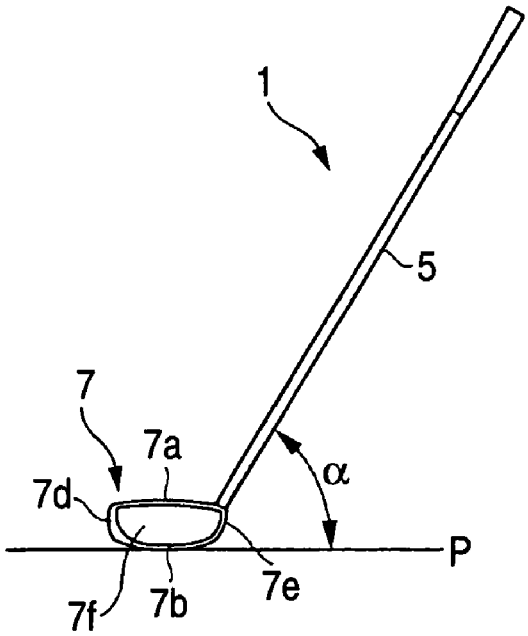
FIG. 5 is a diagram showing a first embodiment of a golf club according to the invention, which is a front view of the golf club.
Figure 6:
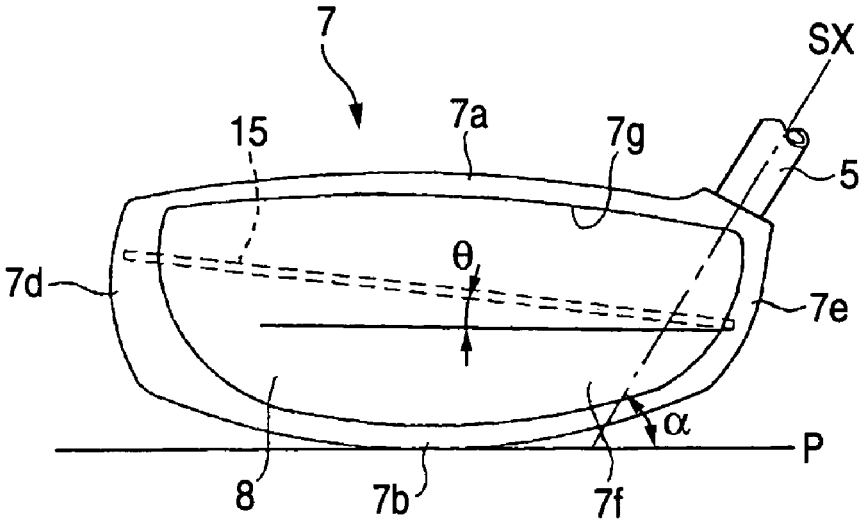
FIG. 6 is an enlarged view of the head portion.
Figure 7:
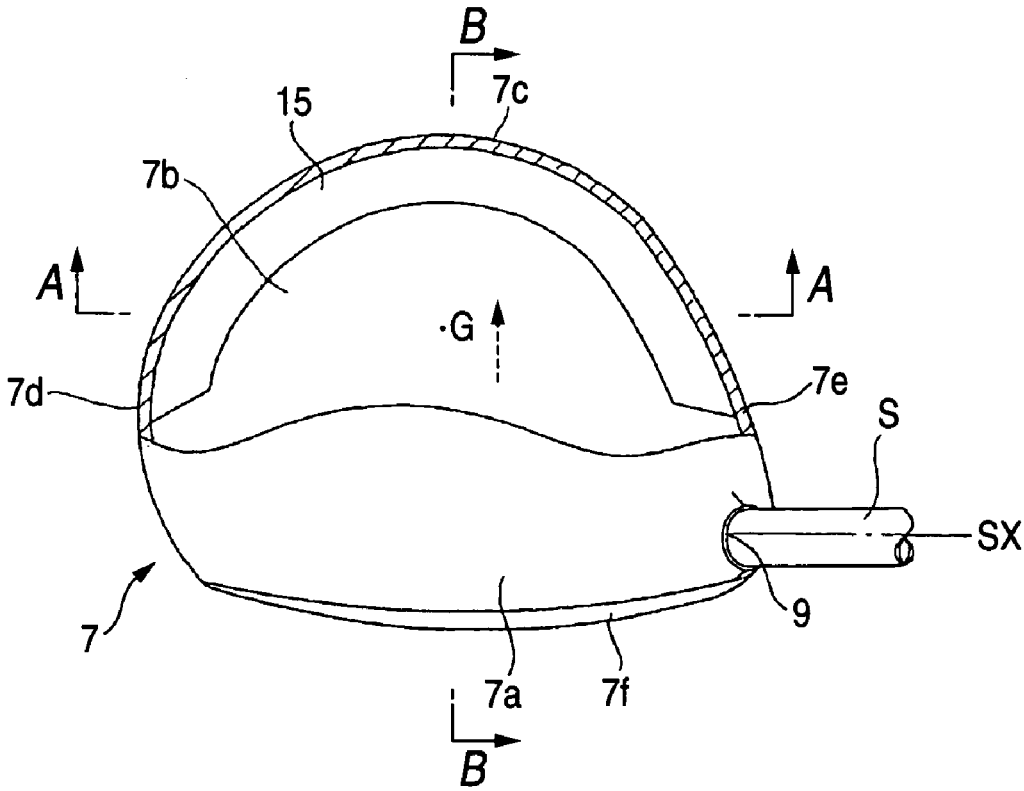
FIG. 7 is a plan view which shows a partially cutaway crown portion of the head portion.
Figure 8:
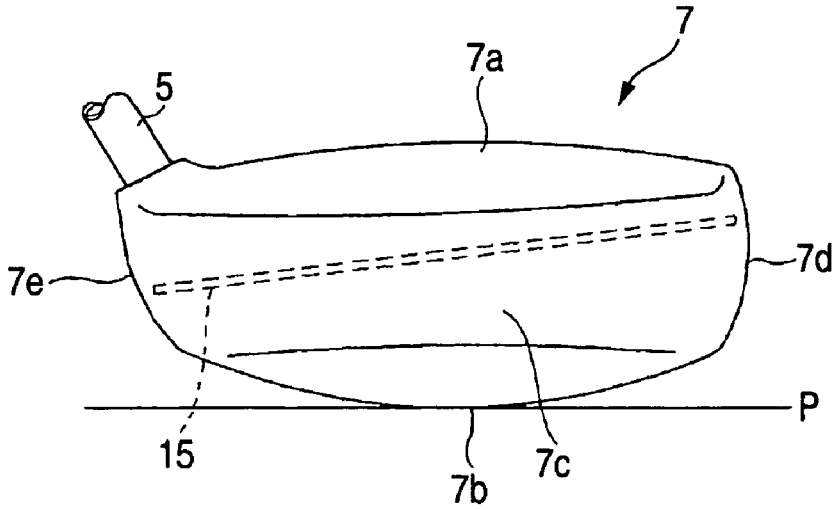
FIG. 8 is a diagram which shows the head portion as viewed from a back portion side.
Figure 9:
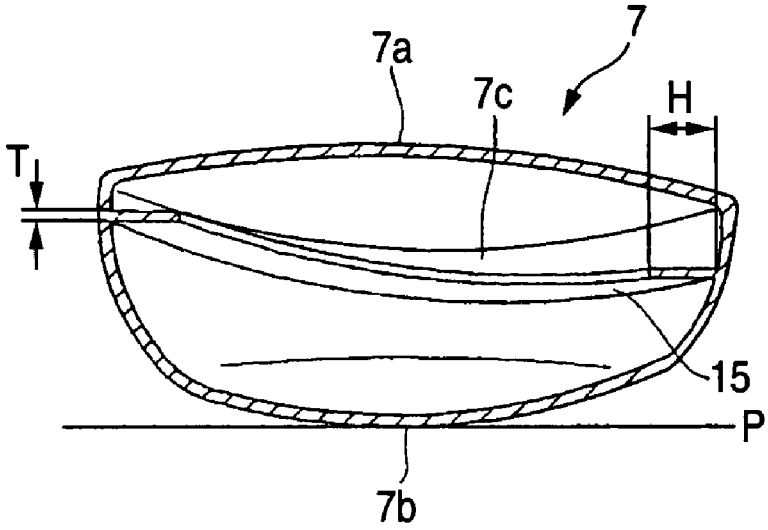
FIG. 9 is a sectional view taken along the line A-A in FIG. 7.
Figure 10:
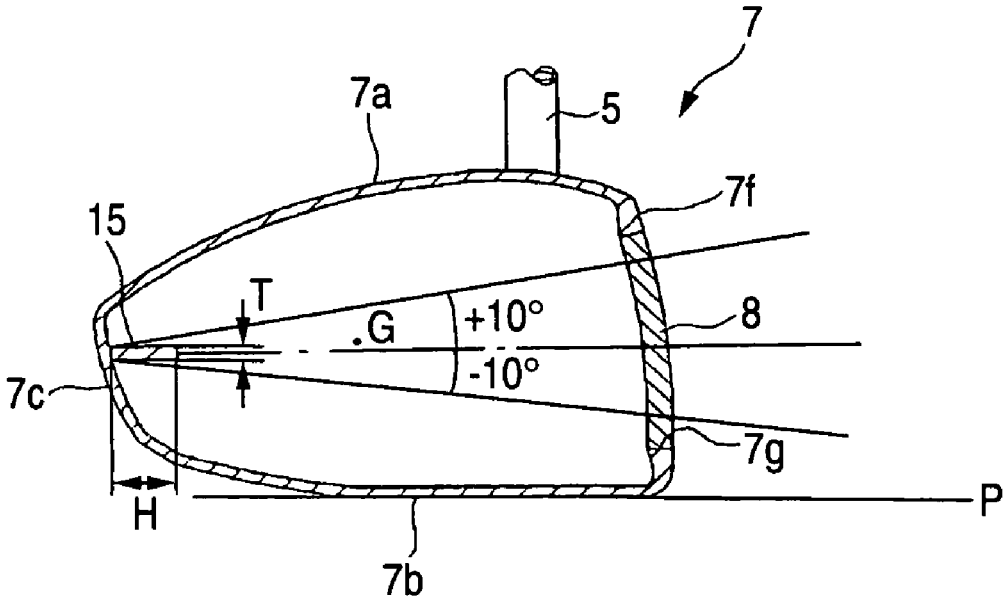
FIG. 10 is a sectional view taken along the line B-B in FIG. 7.

FIGS. 5 to 10 are drawings which show a first embodiment of a golf club according to the invention, in which FIG. 5 is a front view of the golf club, FIG. 6 is an enlarged view of a head portion, FIG. 7 is a plan view which shows a partially cutaway crown portion of the head portion, FIG. 8 shows the head portion as seen from a back portion side thereof, FIG. 9 is a sectional view taken along the line A-A in FIG. 7, and FIG. 10 is a sectional view taken along the line B-B in FIG. 7.

A golf club 1 according to the embodiment includes a head 7 with a hollow outer shell construction that is securely fastened to a distal end of a shaft 5 and which is made up of a crown portion 7*a*, a sole portion 7*b*, a back portion 7*c*, a toe portion 7*d*, a heal portion 7*e* and a face portion 7*f* which hits a ball. In this case, in the head 7 of the embodiment, a substantially rectangular opening 7*g* is formed in the face portion 7*f*, and a face member 8 is securely fastened in the opening 7*g* so formed by virtue of fusion bonding, press fitting, adhesive bonding or the like so as to form a hitting surface. Note that the face portion 7*f* itself may make up the hitting surface without forming the opening in the face portion 7*f* and securely fastening the face member 8 in the opening.

The head 7 is integrally molded by virtue of casting except for the face member 8, which is formed by stamping and is formed into a hollow outer shell construction by securely fastening the stamped face member 8 in the opening 7*g*. In this case, the outer shell member which is a portion of the head 7 excluding the face member 8 is made of, for example, stainless steel, stainless steel alloy, titanium, titanium alloy and the like, and the face member 8 is made of, for example, titanium alloy or the like which has a large specific strength. In addition, a shaft fastening hole 9 is formed in the crown portion 7*a* of the head 7, and a shaft 5 made of metal or FRP is mounted in this hole towards a hollow portion formed in the outer shell member. Note that the respective portions (the crown portion, the sole portion, the back portion, the toe portion, the heel portion and the face portion) which make up the outer shell member may be constructed into frames to which respective members that are formed of other materials (FRP, FRM and the like) are securely fastened.

A weight concentrated portion (a heavy material) 15 is provided on the back portion 7*c*, the toe portion 7*d* and the heel portion 7*e* integrally and continuously. This weight concentrated portion 15 is a portion where a larger mass than that of its peripheral portion is concentrated, and at the weight concentrated portion 15, the weight is not concentrated at a specific single point but is made to extend from the center of the back portion 7*c* to the toe portion and the heel portion, respectively, and in this embodiment, the weight concentrated portion 15 is made up of a rib-shaped member which continuously project towards a central side of the hollow portion.

The weight concentrated portion 15, which is formed into the rib shape, can be formed integrally with the outer shell member and the larger mass than that of its peripheral portion is concentrated thereat by being positioned closer to a back portion side of the head 7 than an axis SX of the aforesaid shaft and having predetermined height and thickness. Then, in this embodiment, as shown in FIG. 6, the rib-shaped weight concentrated portion 15 is formed in such a manner as to rise from a heel side to a toe side of the head 7 with respect to a reference horizontal plane P which regulates a lie angle α of the head 7 as viewed from the front.

According to the golf club on which the head 7 configured as has been described heretofore is mounted, since the weight concentrated portion 15 is not disposed along the reference horizontal plane P which regulates the lie angle α of the head 7 but has a directionality in which the weight concentrated portion 15 rises from the heel side towards the toe side, the swing plane during downswing can be made relatively stable for the weight of the head.

Figure 1:
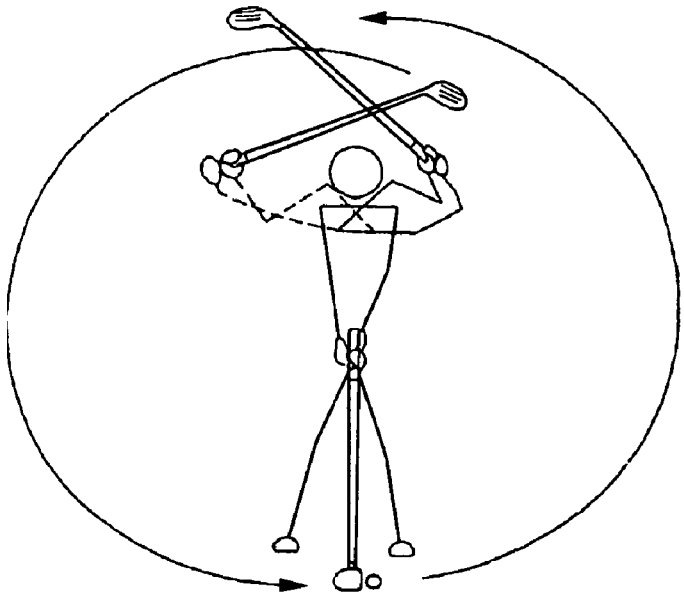
FIG. 1 is an exemplary diagram which explains a swing path of a golf player.
Figure 2:
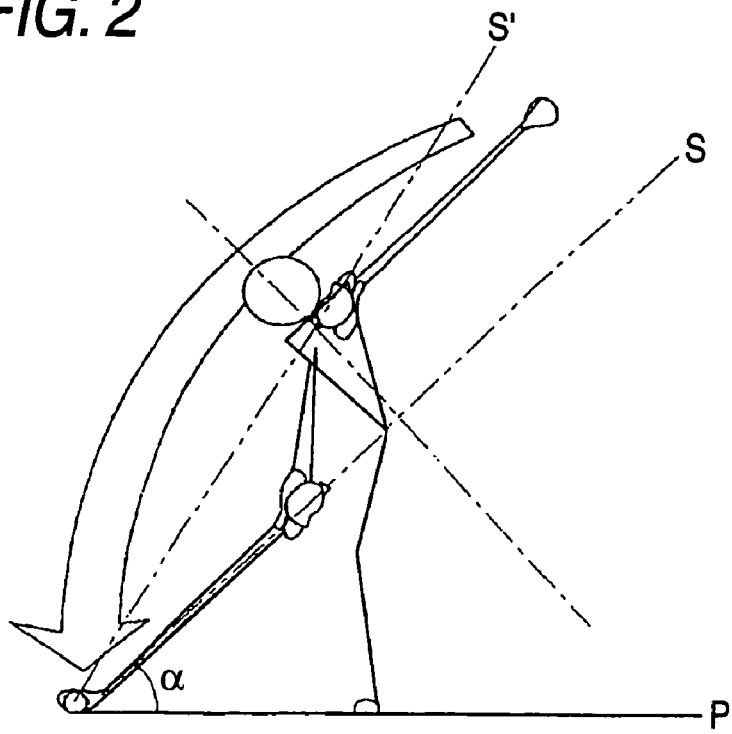
FIG. 2 is a front view of the swing path shown in FIG. 1.
Figure 3A:
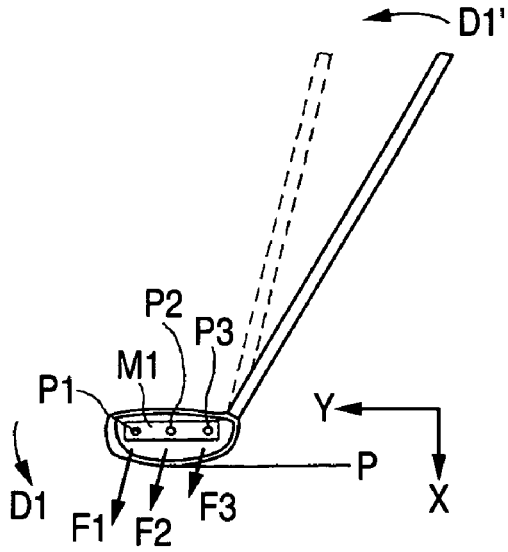

Namely, as has been described with reference to FIGS. 3(*a*) and 4, when the unnatural force is exerted during the swing to the impact point of the ball, there is caused the problem that the swing plane is not stabilized, and this unnatural force is, as has been described above, caused mainly by the exertion of the different centrifugal forces (F1>F2>F3) on the respective positions on the head mounted at the distal end of the shaft.

Figure 3B:
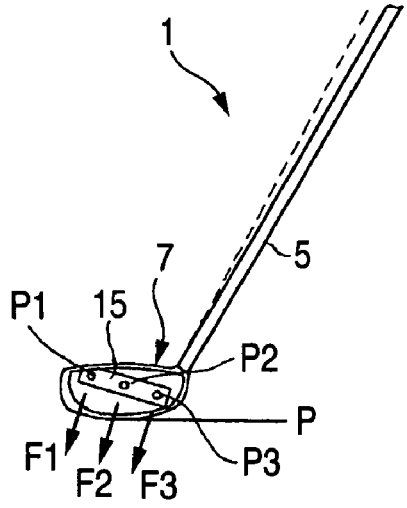
Figure 4:
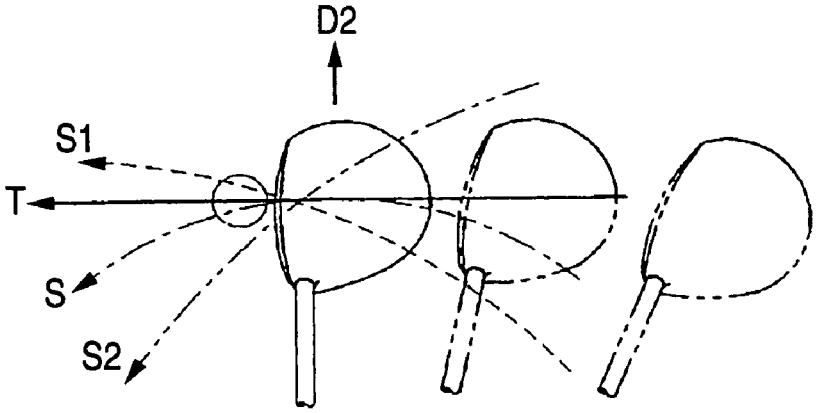
FIG. 4 is a plan view which shows the movement of a head at the time of impact.

In this embodiment, however, as has been described above, since the weight concentrated portion 15 has the directionality in which it rises from the heel side to the toe side of the head 7, when considering a centrifugal force that is to be exerted on the head portion while a downswing is being performed (considering the same positions P1, P2, P3 as those shown in FIG. 3A), as shown in FIG. 3B, centrifugal forces F1, F2, F3 which are exerted, respectively, on the toe side, the central portion and the heel side can be made substantially equal in magnitude. Namely, since the weight concentrated portion 15 is given the directionality in which it rises from the heel side towards the toe side, the distances from a grip portion along the longitudinal direction of the shaft to the positions where the weights exist at the respective positions can be made substantially equal, whereby the magnitudes of the centrifugal forces F1, F2, F3 exerted, respectively, on the toe side, the central portion F2 and the heel side can be made substantially the same.

As a result, since the centrifugal forces exerted on the respective positions of the head 7 become stable, no such unnatural force as the unnatural forces D1, D2 shown in FIGS. 3(*a*) and 4 is exerted during downswing in any case, whereby the ball can be hit in the stable swing plane at the end of the downswing. Then, since the ball can be hit in such a stable swing plane, the ball can easily be caught at the sweet spot of the head, whereby not only can the directionality of the ball hit be stabilized but also an increase in flying distance of the ball can be realized.

In addition, as shown in FIG. 7, the weight concentrated portion 15 is provided closer to the back portion side of the head 7 than the axis SX of the shaft 5, a face portion side of the head can be made difficult to be deflected vertically during swing, thereby making it possible to stabilize the swing. Additionally, since the weight concentrated portion 15 is provided at in particular the back portion 7*c* which constitutes a rearmost position of the head 7 and is provided in such a manner as to extend, respectively, towards the toe and heel portions, the position of the center of gravity G can be offset towards the back side of the head 7 so as to be set at a suitable position for in particular a driver, and the balance in the lateral direction (the toe-to-heel direction) is improved. Furthermore, the moment of the inertia about the center of gravity is increased, whereby a golf club can be provided which can strongly resist against deflection in hitting point in the vertical direction (the crown-to-sole direction) and the lateral direction (the toe-to-heel direction). Namely, even in the event that the hitting point deflects vertically and laterally when hitting the ball, the movement of the head 7 can be suppressed, whereby a golf club can be obtained which can obtain a stable directionality.

As to the directionality of the weight concentrated portion 15, the inclination angle θ of the golf club is set to fall within a range from 3° to 45° and preferably a range from 5° to 30° with respect to the reference horizontal plane P when the golf club is set in the proper lie angle thereof. Namely, in the event that the inclination angle θ is smaller than 3°, there is caused from the phenomenon shown in FIG. 3A a tendency in which the swing plane is not stabilized, and in the event that the inclination angle θ becomes larger than 45°, the weight concentrated portion is formed at a higher position on the toe side on the head, and the position of the center of gravity becomes too high, whereby the amount of spin imparted to the ball becomes excessive when the ball is hit, thereby making it difficult to increase the distance. In addition, in the event that the inclination angle θ becomes smaller than 45°, the weight concentrated portion 15 cannot extend, respectively, towards the toe and heel portions over a sufficient length, thereby making it difficult to stabilize the swing plane.

In addition, in the configuration that has been described above, since the weight concentrated portion 15 is formed into the rib shape and is formed continuously and integrally on the back portion 7*c*, the toe portion 7*d* and the heel portion 7*e* which constitute the outer shell member, the weight concentrated portion 15 can be formed integrally with the outer shell member when it is molded, and hence there is no need to consider a change in weight that will otherwise be caused by a welding material, a bonding material or the like which is used to securely fasten the weight concentrated portion in case it is provided as a separate member. Of course, the weight concentrated portion 15 does not have to be continuous as is described above but may be provided in spots which scatter with a predetermined directionality or may be formed only at the toe portion and the heel portion. However, with no heavy portion residing at the center of the head, since the ball tends to be easily hit at a portion on the face of the head which deviates from the sweet spot, it is preferable that the weight concentrated portion is formed at the toe portion, the heel portion and an in-between portion. Alternatively, a configuration may be adopted in which the weight concentrated portion 15 is not formed integrally with the outer shell member but a member which constitutes a heavy material is mounted on the outer shell member. In addition, the weight concentrated portion that takes the form of such a heavy material may be provided on the outer shell member of the head in such a manner as to be distended outwardly so as to be recognized from the outside.

Note that the weight concentrated portion 15 is preferably formed such that the weight of the weight concentrated portion 15 that is provided with the aforesaid directionality (in this embodiment, the weight of the portion of the outer shell member that makes up the head 7 which protrudes from the inherent thickness of the outer shell member) shares 3.0 to 70.0% of the weight of the whole of the head (the whole weight of the head 7 resulting when the shaft 5 is removed therefrom). Namely, the reason why the weight of the weight concentrated portion 15 is set to fall within such a range is because in the event that the weight concentrated portion 15 is formed such that it shares a ratio of the weight less than 3.0%, the influence by the horizontal weight distribution due to the weight of the sole portion becomes large during swing, whereby the aforesaid effect of stabilization of the swing plane cannot be exhibited sufficiently, whereas, in the event that the weight concentrated portion 15 is formed such that it shares a ratio of the weight larger than 70.0%, the position of the center of gravity of the head 7 is influenced to much, whereby the sweet spot is eventually positioned too high.

In this case, while there is no specific limitation on a thickness T and a height H that are shown in FIGS. 9 and 10, it is preferable that the weight concentrated portion 15 is formed thicker and higher than the peripheral portion thereof (the outer shell member) so that a large physical difference is produced compared with the peripheral portion, whereby the degree of weight concentration can be sensed by the golf player when he or she swings the golf club. Namely, by adopting this configuration, a difference in force due to an exertion of centrifugal force in the face-to-back direction is eliminated, whereby the face is made difficult to be deflected in the direction of the swing plane, thereby making it possible to facilitate a stable swing. In addition, the weight concentrated portion can be made difficult to vibrate when hitting the ball, whereby the transmission of energy is increased, thereby making it possible to realize an increase in distance. Note that while the rib preferably extends along a direction which follows the horizontal plane P, the rib may be oriented towards the face portion at an angle of +/−10° relative to the horizontal plane P, as shown in FIG. 10.

Figure 11:
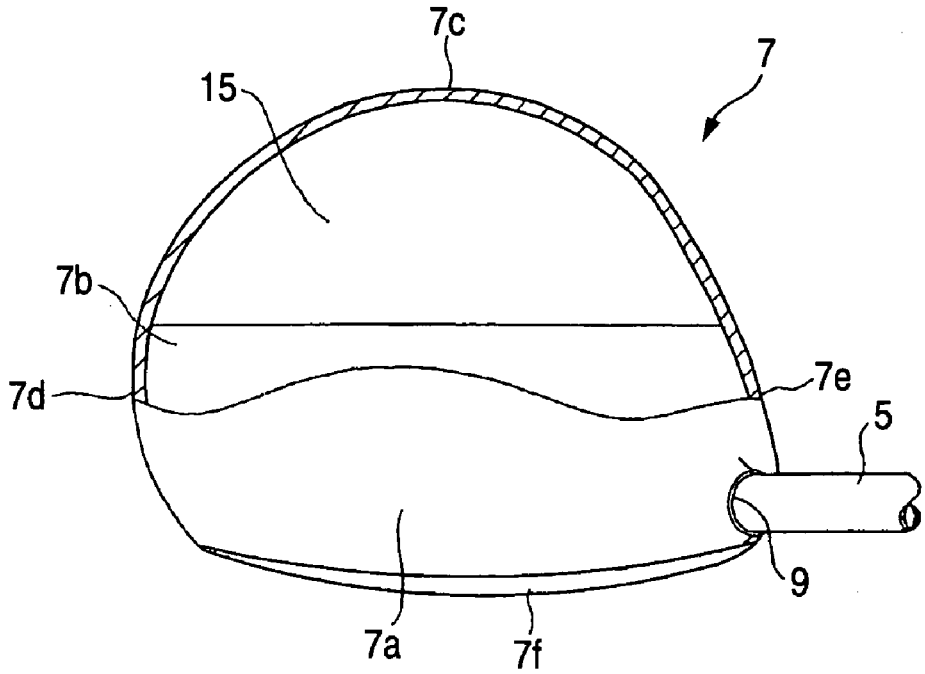
FIG. 11 is a plan view showing a crown portion of a head portion that is partially cutaway to show a first modified example.

In addition, the rib-shaped weight concentrated portion may be formed into a plate shape which extends from the center of the back portion towards the toe and heel portions, respectively, as shown in FIG. 11. Since the mass is disposed in a direction in which the surface of the plate shape extends by forming the weight concentrated portion into the plate shape on the back portion side of the head, the head is made to easily travel in that direction, whereby the straight line head stability in the impact area can be improved.

Furthermore, while the weight concentrated portion 15 may be formed with the same thickness and height entirely or may be formed linearly as shown in the figure, the weight concentrated portion 15 may be formed with a height and a thickness which are partially changed or into a curved shape. To be specific, in the exemplary diagram shown in FIG. 3B, a centrifugal force increasing means is preferably provided which increases the centrifugal force F2 which is exerted on the central portion (preferably an area which passes through the center of gravity) of the head so high that the centrifugal force F2 becomes higher than the centrifugal force F1 which is exerted on the toe side and the centrifugal force F3 which is exerted on the heel side.

Namely, since the toe side and the heel side of the weight concentrated portion 15 is balanced on the central portion thereof, which functions as the center of the same portion, by being configured as has been described above, not only can the stabilization of the swing plane be realized but also the weight in the vicinity of the sweet spot can be made to be sensed by the golf player, whereby the improvement in directness of the head can be realized, and hence the ball can easily be hit by a portion of the head which is in the vicinity of the sweet sport.

Figure 12:
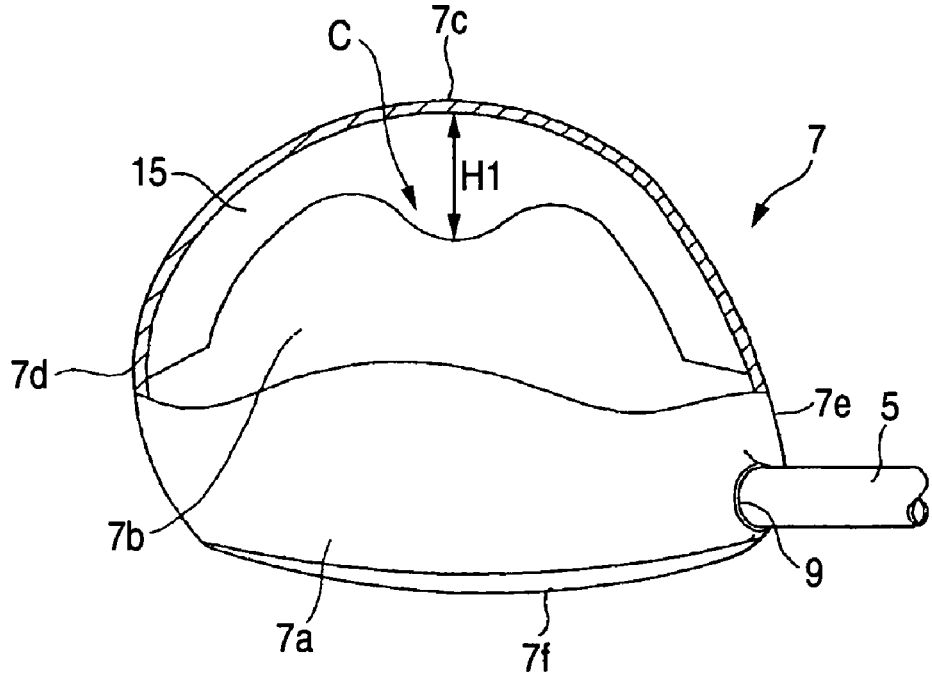
FIG. 12 is a plan view showing a crown portion of a head portion that is partially cutaway to show a second modified example.
Figure 13:
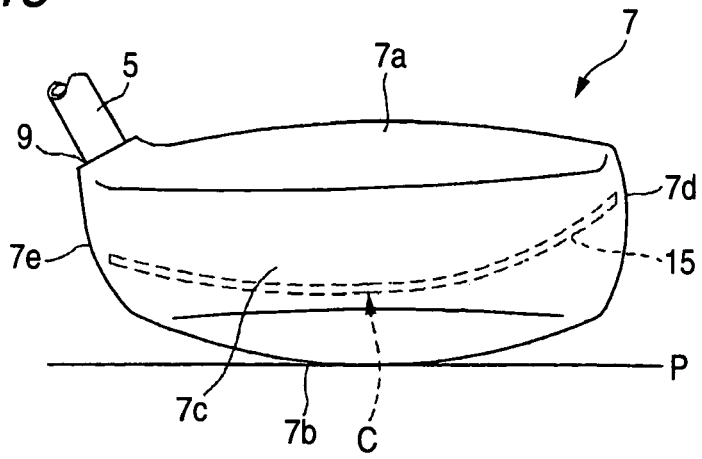
FIG. 13 is a diagram showing a third modified example as seen from a back portion side of a head portion.

The centrifugal force increasing means can be made by increasing the weight at the central portion of the weight concentrated portion or increasing the distance from the grip portion to the central portion of the weight concentrated portion. For example, as shown in FIG. 12, the weight at the central portion may be made heavier than on the toe side and the heel side by making a height H of the rib-shaped weight concentrated portion 15 at a central area C thereof higher than heights at other portions thereof or making a thickness of the central area or portion thicker than thicknesses at other portions thereof (not shown). Alternatively, as shown in FIG. 13, the distance to the central portion may be made longer than the distances to the toe side and the heel side by curving the central area C downwards (of course, the configurations may be combined arbitrarily).

Figure 14:
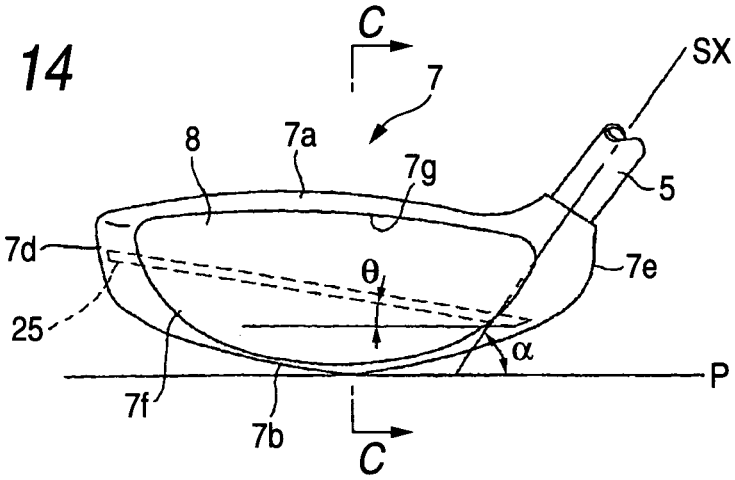
FIG. 14 is a front view of a head according to a second embodiment of the invention which is to be mounted on a shaft.
Figure 15:
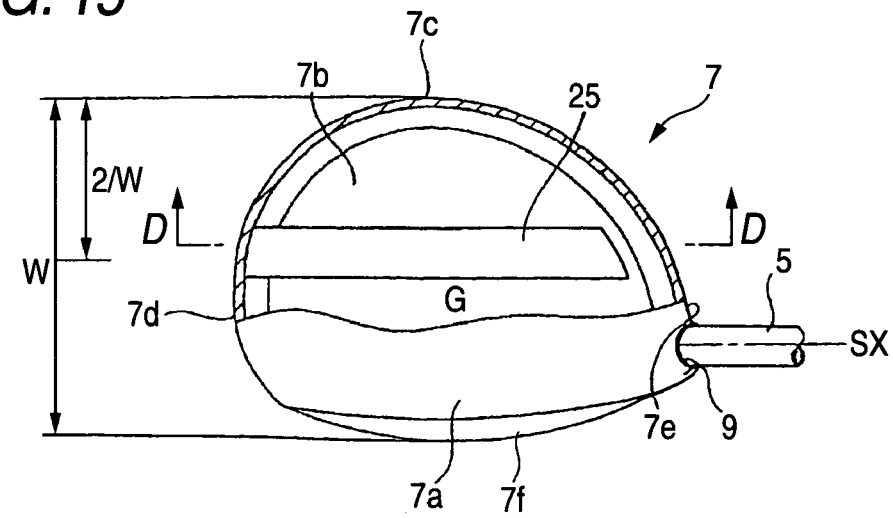
FIG. 15 is a plan view of a partially cutaway crown portion of a head portion.
Figure 16:
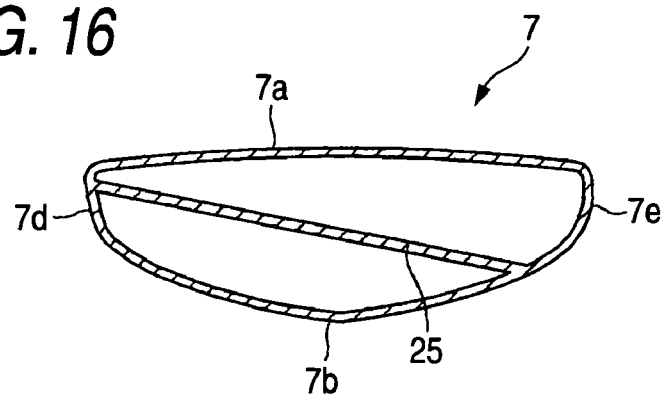
FIG. 16 is a sectional view taken along the line D-D in FIG. 15.
Figure 17:
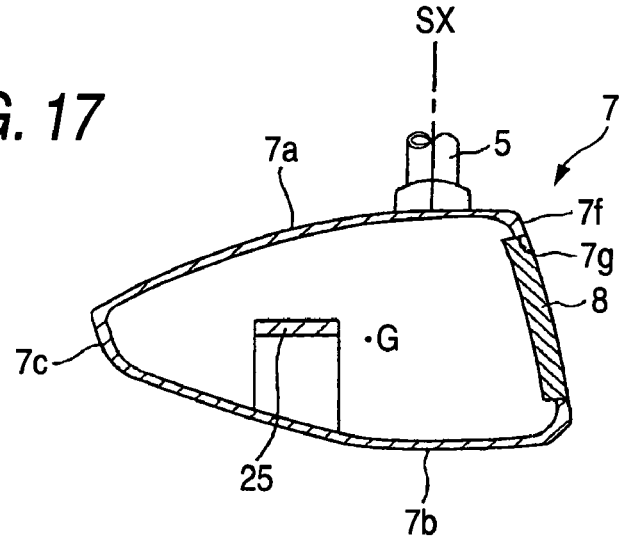
FIG. 17 is a sectional view taken along the line C-C in FIG. 14.
Figure 18:
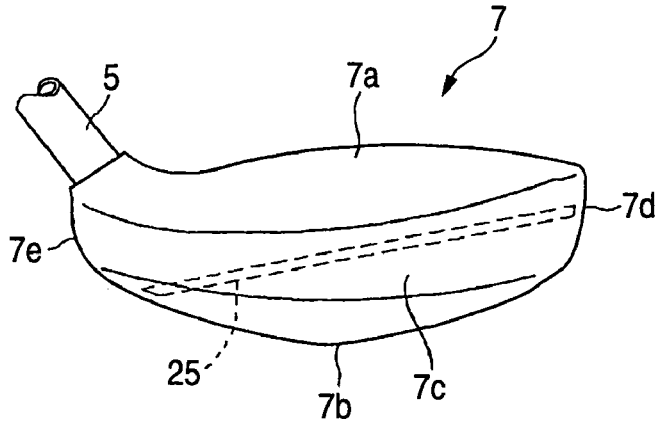
FIG. 18 is a diagram which shows a head portion as viewed from a back portion side.

FIGS. 14 to 18 show a second embodiment of the invention, in which FIG. 14 is a front view of a head that is to be mounted on a shaft, FIG. 15 is a plan view which shows a partially cutaway crown portion of a head portion, FIG. 16 is a sectional view taken along the line D-D in FIG. 15, FIG. 17 is a sectional view taken along the line C-C in FIG. 14, and FIG. 18 shows the head portion as seen from a back portion side thereof.

This embodiment is configured so as to be suitably applied to a wood-type golf club for use from the fairway, and a weight concentrated portion is placed such that the position of center of gravity becomes as low as possible in consideration of an easy drive that soars into the air. Namely, this embodiment is configured so as not only to obtain the advantage obtained by the first embodiment but also to make the center of gravity of the head as low as possible.

To be specific, a weight concentrated portion 25 is formed between a face portion and a back portion of an outer shell member in such a manner as to extend laterally along a toe-to-heel direction. Namely, the weight concentrated portion 25 is made of a plate-shaped member as shown in the figures, and as shown in FIG. 16, one end side thereof is connected to a position of a heel portion 7*e* that is relatively close to a sole portion 7*b* side thereof, whereas the other end side of the weight concentrated portion 25 is connected to a position on a toe portion 7*d* that is relatively close to a crown portion 7*a* side thereof, whereby as in the case with the first embodiment that has been described previously, an area to which the weight is concentrated is formed in such a manner as to rise from a heel side to a toe side of the head.

While provided closer to a face portion side of the head 7, the weight concentrated portion 25 is still disposed closer to a back portion side than to the axis SX of the shaft 5, and by being disposed at such a position, as in the case with the first embodiment, the generation of a vertical deflection on the face portion side is suppressed during swing and at impact of the ball. In this case, as shown in FIG. 15, while the center of gravity is shifted further forwards as the position where the weight concentrated portion 25 is disposed is shifted closer to the face portion side, so that the center of gravity of the head can be made as low as possible (the sweet spot is made as low as possible), the tendency that the face portion side is deflected vertically is increased higher during swing and at impact of the ball as the weight concentrated portion 25 is shifted further forwards. To cope with this, as shown in FIG. 15, the weight concentrated portion 25 is preferably provided closer to the back portion side than one-half a width between the face portion and the back portion.

By disposing the weight concentrated portion at the position that has been described above, a golf club can be provided in which the center of gravity of the head 7 can be made as low as possible so as to be suitable for a fairway wood used to hit a ball in such a state that the ball is not on the tee and in which the generation of vertical deflection on the face portion side is suppressed effectively.

Note that in this embodiment, too, as with the first embodiment, the inclination angle θ of the golf club is set to fall within a range from 3° to 45° and preferably a range from 5° to 30° with respect to the reference horizontal plane P of the weight concentrated portion 25. In addition, as with the first embodiment, the thickness of the weight concentrated portion 25 may also be made thicker than that of the outer shell member or the centrifugal force increasing means may be provided in order to facilitate the sensing of the degree of concentration of weight.

In addition, while the weight concentrated portion 25 is provided in such a manner as to extend between the heel portion and the toe portion with the ends thereby formed integrally with the heel portion 7*e* and the toe portion 7*d*, for example, a configuration may be adopted in which a substantially vertical wall portion is provided on a sloe portion 7*b* in such a manner as to extend towards a crown portion 7*a*, so that the weight concentrated portion is placed on an upper end portion of the wall portion so provided.

Thus, while the embodiments of the invention have been described heretofore, according to the invention, the weight concentrated portion may only have to be provided further rearwards than the axis SX of the shaft 5 in such a manner as to rise from the heel side to the toe side with respect to the reference horizontal plane P, the overall shape and material of the head and the method of forming the same can be modified variously.

In this case, too, the weight concentrated portion may be such as to be formed integrally with the outer shell member that makes up the head by casting (the area where weight is concentrated is formed thicker or into the rib shape) or the configuration may be adopted in which a separate heavy material (a heavy material such as a weight) where weight is concentrated is securely mounted on the outer shell member at the position that is in the vicinity thereof by virtue of welding, bonding and the like. Additionally, the weight concentrated portion may be such as to be provided on the head with the aforesaid directionality, and for example, the weight concentrated portion may be made up of a number of heavy materials which are disposed with the directionality (or scattered with the directionality). As this occurs, the heavy materials that are adjacent to each other may be securely fastened to a back side of the outer shell member of the head by virtue of welding, bonding and the like or they may be molded integrally with the outer shell member.

In addition, as shown in FIG. 13, in the vent that the directionality of the weight concentrated portion is curved, the heel side position of the weight concentrated portion 15 where the weight concentrated portion 15 is formed on the heel portion side of the head (or where the weight concentrated portion 15 is mounted on the heel portion side of the head) may only have to be positioned higher than the toe side position of the weight concentrated portion 15 where the weight concentrated portion 15 is formed on the toe portion side of the head (or where the weight concentrated portion 15 is mounted on the toe portion side of the head) as viewed as a whole.

Furthermore, in the golf club according to the invention, apart from the weight concentrated portion which extends in such a manner as to rise from the heel side to the toe side with respect to the reference horizontal plane P, another weight concentrated portion may be provided in the interior of the head. For example, a separate weight concentrated portion is preferably disposed in a center area of the head (preferably, an area which passes through the center of gravity of the head) in such a manner as to extend from the crown portion to the sole portion via the back portion. By adopting the configuration like this, since the sensible heavy material is aligned along the vertical direction of the central area of a hollow portion of the head so that the heavy material extends along the swing plane during downswing, the improvement in directness of the head can be realized, and in conjunction with the aforesaid advantage, the swing can be stabilized further. In addition, a heavy material may be disposed at any position in the interior of the head so as to adjust the position of the center of gravity of the head.

In addition, in the above configuration, the thickness of the outer shell member except for the weight concentrated portion is preferably made thinner than that of the weight concentrated portion and made uniform throughout the outer shell member. By making the thickness of the outer shell portion uniform throughout thereof, since portions where the weight differs are not scattered, the deflection of the head or the like can be made difficult to occur during swing.

What is claimed is:

1. A golf club comprising:

a head with a hollow outer shell construction comprising:

a crown portion;

a sole portion;

a back portion;

a toe portion;

a heel portion; and a face portion for hitting a ball;

a shaft attached to the head at a predetermined lie angle; and a weight-concentrated portion provided closer to a side of the back portion than to an axis of the shaft in an interior of the head in such a manner as to rise from a side of the heel to a side of the toe with respect to a reference horizontal plane which regulates the lie angle and not to fall from the side of the heel to the side of the toe, wherein the weight-concentrated portion is not provided closer to a side of the face portion than to the axis of the shaft.

2. The golf club according to claim 1, wherein a direction in which a weight is concentrated by the weight-concentrated portion is set within a range from 3° to 45° with respect to the reference horizontal plane.

3. The golf club according to claim 1, wherein the weight-concentrated portion is provided on the back portion so as to extend from a center of the back portion in directions toward the toe and heel portions.

4. The golf club according to claim 3, wherein the weight-concentrated portion comprises a rib that is integrally formed on an inner surface of the back portion and inner surfaces of the toe portion and the heel portion.

5. The golf club according to claim 1, wherein the weight-concentrated portion is made to extend transversely between the face portion and the back portion.

6. The golf club according to claim 1, wherein the weight-concentrated portion is provided closer to the back portion side than one-half a width between the face portion and the back portion.

7. The golf club according to claim 1 further comprising:

centrifugal force increasing means provided at a central portion of the weight-concentrated portion, wherein the centrifugal force increasing means increases a centrifugal force exerted at the time of downswing higher than a toe-side centrifugal force which is exerted on the toe side by the weight-concentrated portion and a heal-side centrifugal force which is exerted on the heel side by the weight-concentrated portion.

8. The golf club according to claim 1, wherein a direction in which a weight is concentrated by the weight-concentrated portion is set within a range from 5° to 30° with respect to the reference horizontal plane.

9. The golf club according to claim 1, wherein the weight-concentrated portion is thicker than said hollow outer shell.

10. The golf club according to claim 1, wherein the weight-concentrated portion makes up 3.0 to 70.0% of a weight of the head.

11. The golf club according to claim 1, wherein the weight-concentrated portion is disposed in such a manner as to be higher at the toe portion than at the heel portion with respect to the reference horizontal plane.

12. The golf club according to claim 1, wherein the weight-concentrated portion comprises a larger mass than a mass of the outer shell.

13. The golf club according to claim 1, wherein the weight-concentrated portion continuously projects towards a central side of the hollow outer shell.

14. The golf club according to claim 1, wherein the weight-concentrated portion is integrally jointed to the outer shell.

15. The golf club according to claim 1, wherein the weight-concentrated portion is oriented towards the face portion at an angle of +/−10° relative to the reference horizontal plane.

16. The golf club according to claim 1, wherein the weight-concentrated portion comprises a variable thickness and a variable height.

17. The golf club according to claim 1, wherein the weight-concentrated portion has a curved shape.

18. The golf club according to claim 1, wherein the weight-concentrated portion comprises a number of heavy materials which are disposed along the weight-concentrated portion.

19. The golf club according to claim 1, wherein the weight-concentrated portion comprises a higher thickness at a center area of the weight-concentrated portion compared to a side area of the weight-concentrated portion.

20. A golf club comprising:

a head with a hollow outer shell construction comprising:

a crown portion;

a sole portion;

a back portion;

a toe portion;

a heel portion; and a face portion where a ball is hit;

a shaft attached to the head at a predetermined lie angle; and a heavy material which is disposed with a directionality directed from a side of the heel to a side of the toe and is provided closer to a side of the back portion than to an axis of the shaft in an interior of the head, wherein the heavy material is disposed in such a manner as to be higher at the toe portion than at the heel portion with respect to a reference horizontal plane which regulates the lie angle and not to be lower at the toe portion than at the heel portion, wherein the heavy material is not provided closer to a side of the face portion than to the axis of the shaft.

* * * * *